United States Patent [19]

Bull

[11] 4,204,102

[45] May 20, 1980

[54] ELECTRICAL SWITCH

[75] Inventor: David W. Bull, Hersey, Mich.

[73] Assignee: Nartron Corporation, Reed City, Mich.

[21] Appl. No.: 861,436

[22] Filed: Dec. 16, 1977

[51] Int. Cl.[2] ..... H01H 3/12; H01H 3/14; H01H 13/64

[52] U.S. Cl. ..... 200/153 J; 200/153 L; 200/159 R

[58] Field of Search ..... 200/153 J, 153 LA, 159 R, 200/153 L, 68

[56] References Cited

U.S. PATENT DOCUMENTS

| | | | |
|---|---|---|---|
| 2,044,065 | 6/1936 | Douglas | 200/153 J |
| 2,469,337 | 5/1949 | Kohl | 200/153 J |
| 2,623,960 | 12/1952 | Haydon | 200/153 J |
| 2,633,510 | 3/1953 | Schellman | 200/153 J |
| 2,668,204 | 2/1954 | Tregoning | 200/153 J |
| 3,046,377 | 7/1962 | Fraser | 200/153 J |

*Primary Examiner*—Joseph Man-Fu Moy
*Attorney, Agent, or Firm*—Lon H. Romanski

[57] ABSTRACT

An electrical switch assembly is shown as having a switch body slidably receiving a resiliently biased manually actuatable plunger which carries a resiliently deflectable member effective for engaging, when said plunger is suitably actuated, a related pivotally supported member which, in turn, is operatively connected to a movable electrical contact member effective for contacting cooperating relatively stationary electrical contacts.

32 Claims, 32 Drawing Figures

ELECTRICAL SWITCH

BACKGROUND OF THE INVENTION

Heretofore, the prior art has proposed various forms of electrical switch assemblies of the class which may be referred to as "Push-on Push-off" or "Push-Push". That is, such switches, when first actuated as by pushing a related actuator plunger, are capable of completing a first electrical circuit and, when again actuated, as by again pushing the same actuator plunger, are capable of either: (a) opening that first electrical circuit or (b) completing a second electrical circuit. Often such switches are also referred to as being toggle switches in that toggle mechanisms are often employed therein for causing, alternately, the making and/or breaking of related electrical circuits.

The prior art switches heretofore proposed have exhibited relatively short useful lives in that often the toggle mechanisms therein are supported in a manner causing such mechanisms to experience undue operating forces, which, in turn, often result in structural failure of the material. Further, especially where the switch assembly is required to be relatively small in order to be accommodated within available space defined by related environment, the prior art switch assemblies exhibit failures arising from inability to carry relatively high currents.

The invention as herein disclosed and claimed is primarily directed to the solution of such and other related and attendant problems.

SUMMARY OF THE INVENTION

According to the invention, an electrical switch assembly comprises a switch housing, a plurality of fixed electrical contacts carried by said housing internally thereof, a slide contact selectively engageable with said fixed electrical contacts, a pivotal actuator situated internally of said housing and operatively connected to said slide contact, a manually actuatable plunger slidably received by said housing and resiliently urged in a first direction, and a resiliently deflectable actuator carried by said plunger and effective upon said plunger being moved in a second direction opposite to said first direction for engaging and positioning said pivotal actuator into either of two operating positions.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain elements and/or details may be omitted from one or more views.

DETAILED DESCRIPTION OF THE PREFERRED EMBODIMENT

Figure 1:
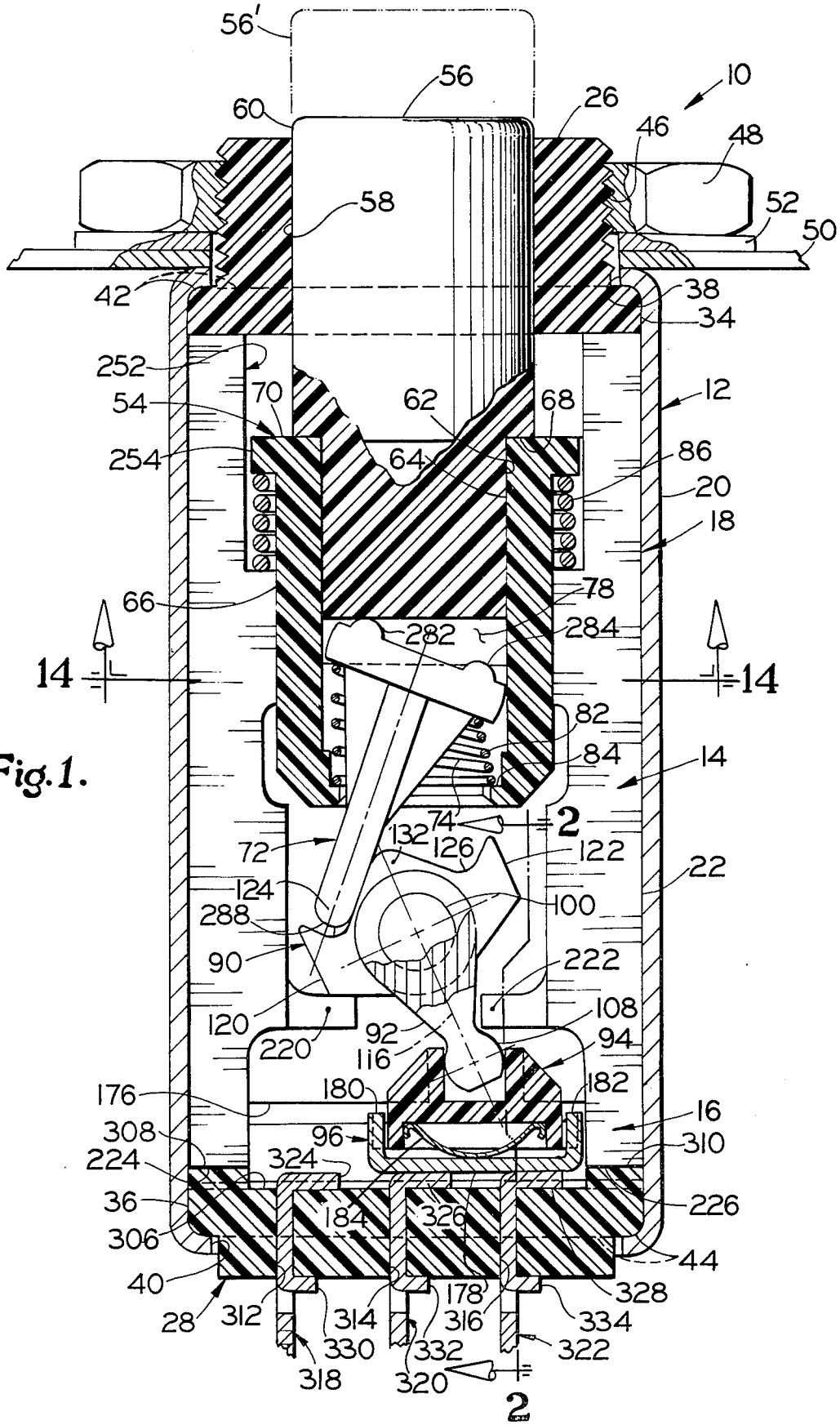
FIG. 1 is a generally vertical axial cross-sectional view of a switch assembly embodying teachings of the invention, with portions thereof being shown in elevation.

Referring now in greater detail to the drawings, FIG. 1 illustrates an electrical switch 10, embodying teachings of the invention, as comprising housing means 12 which contains or carries actuating means 14 and electrical contacting means 16. The housing means 12, in turn, may comprise inner housing means 18 and outer housing means 20 with inner housing means 18 comprising juxtaposed housing sections 22 and 24 and upper and lower end housing sections 26 and 28, respectively. Preferably, housing sections 22, 24, 26 and 28 are formed of electrically non-conductive material such as, for example, polycarbonate. Outer housing means 20 is preferably of cylindrically tubular configuration which closely receives the outer cylindrical surfaces 30 and 32 of inner housing sections 22 and 24, respectively, as well as the outer cylindrical surfaces 34 and 36 of top and bottom end housing sections 26 and 28, respectively, while also axially containing such housing sections in assembled relationship as by formed-over generally annular end portions 38 and 40 which respectively engage annular shoulder-like or flange-like surfaces 42 and 44 of end housing sections 26 and 28.

End housing section 26 is preferably generally of stepped cylindrical configuration with a threaded portion 46 formed thereon as to be threadably engageable with related nut means 48 thereby enabling the entire switch assembly 10 to be removably secured to and carried by related support structure 50. As is known in the art, suitable washer or locking means may be provided as at 52.

The actuating means 14 is shown as comprising plunger-like means 54 which, in turn, is illustrated as comprising a cylindrical stepped manually engageable actuating member 56 slidably received as by its cylindrical surface 58 in a cooperating cylindrical surface 60 of end housing section 26. The smaller or stepped cylindrical extension 62 of actuator member 56 is closely received by an inner cylindrical surface 64 of a generally cylindrical tubular member 66 in a manner as to have the annular shoulder 68 of actuator member 56 abut against an end surface 70 of tubular member 66. In the preferred embodiment, members 56 and 66, which are preferably formed of electrically non-conductive plastic material such as, for example, polycarbonate, are fixedly secured to each other as by, for example, sonic welding or the use of an adhesive or bonding agent in order to make such members 56 and 66, operationally, a unitized structure.

Figure 14:
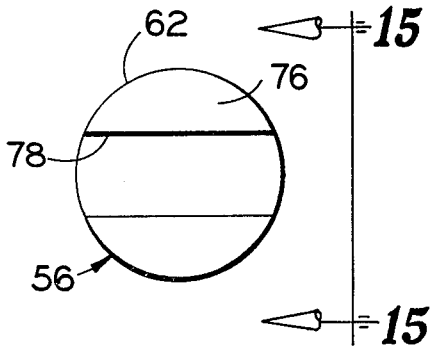
FIG. 14 is an end view of one of the elements shown in FIG. 1 taken generally on the plane of line 14—14 of FIG. 1, with other elements falling in said plane not being shown, and looking in the direction of the arrows.
Figure 15:
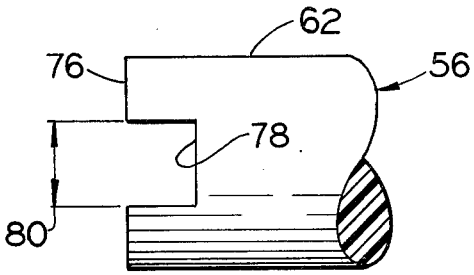
FIG. 15 is a fragmentary side elevational view of the element shown in FIGS. 1 and 14 taken generally on the plane of line 15—15 of FIG. 14 and looking in the direction of the arrows.

As shown in FIG. 1, a resiliently deflectable member 72 is generally carried in the open end or chamber-like portion 74 which is defined, generally, as by the inner surface 64 of tubular member 66 and the end of actuator member 56. Referring to each of FIGS. 1, 14 and 15, it can be seen that the lower end 76 of actuator member 56 is provided with a transverse slot, groove or recess 78 therein which has an effective width 80 for closely receiving and guiding a portion of the resiliently deflectable member 72.

As shown in FIG. 1, resilient means such as a coiled compression spring 82, seated as on an internally formed flange portion 84 of tubular member 66, serves to continually urge deflectable member 72 both upwardly and toward a generally neutral or null position which would be that when member 72 assumes an attitude wherein its longitudinal axis is generally colinear with the axis of actuating means 54. Further, resilient means such as a coiled compression spring 86 serves to continually urge the assembly of members 56, 66 and 72 upwardly, as viewed in FIG. 1, until flange 70 abuts against inner axial end surface 88, of housing end section 26, at which point member 56 may have its outer end in a position as generally depicted in phantom line at 56'.

Figure 2:
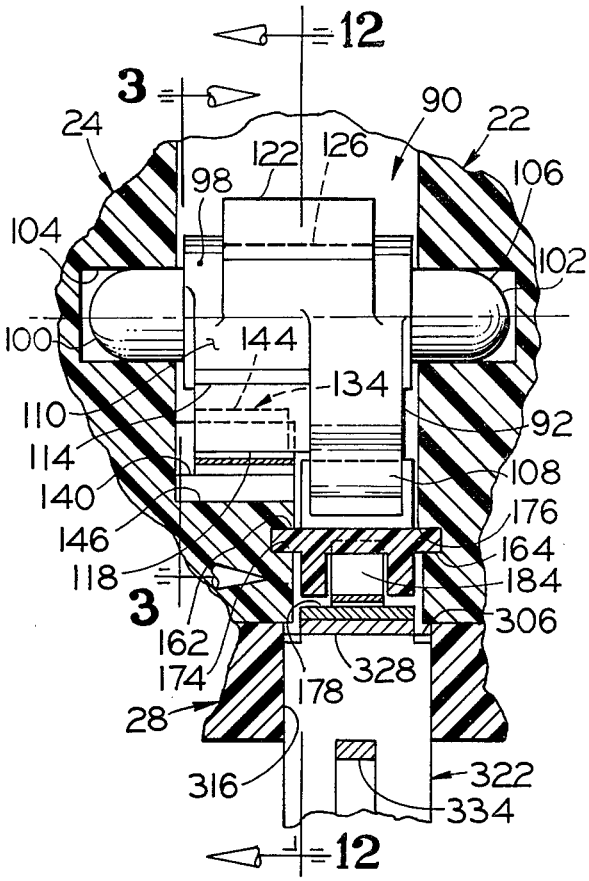
FIG. 2 is a fragmentary cross-sectional view taken generally on the plane of line 2—2 of FIG. 1 and looking in the direction of the arrows.
Figure 4:
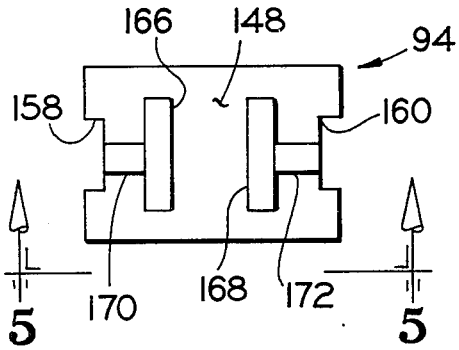
FIG. 4 is a top plan view of one of the elements shown in FIGS. 1 and 2.

With reference to each of FIGS. 1, 2 and 3, a pivotally mounted actuator member 90, situated as viewed in FIG. 1 generally below tubular member 66, has a first arm portion 92 operatively engaged with a slider or contact block member 94 which, in turn, is operatively connected with a movable or sliding electrical contact 96. As best seen in FIG. 2, actuator 90 is illustrated as comprising a main body portion 98 with axially aligned and oppositely extending pivot or journal members 100 and 102 respectively pivotally received within cooperating pivot or journal supports 104 and 106 which, in turn, are respectively formed in housing sections 24 and 22. As can be seen, arm 92, carried by body portion 98 as to be generally positioned closer toward body section 22, has its swingable of free end 108 generally cylindrically contoured and received within an accommodating portion of slider 94.

Disposed generally to the left of arm 92, as viewed in FIG. 2, is a second arm member 110 also carried by body portion 98. As best seen in FIG. 3, arm member 110 is provided with notch-like or recess-like portions 112 and 114 arranged, for example, as to be disposed on opposite sides of a plane passing through the middle of arm 92 and the axis of pivotal rotation of body portion 98 and depicted by centerline or trace 116. The recesses 112 and 114 cooperate to define a generally radially extending projection 118 therebetween.

Figure 3:
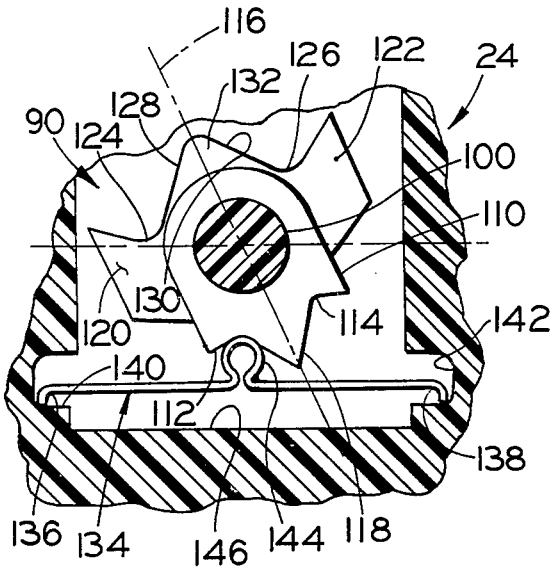
FIG. 3 is a fragmentary cross-sectional view taken generally on the plane of line 3—3 of FIG. 2 and looking in the direction of the arrows.

Body portion 98 also carries third and fourth arm portions 120 and 122 which are provided with V-like notch or recess-like surfaces 124 and 126, respectively, which may also, as best seen in either FIG. 1 or 3, be situated at opposite sides of the plane depicted by trace 116. Preferably, the radially innermost portion of such recess surfaces 124 and 126 is of a curved contour as to closely conform to a cooperating portion of member 72 to be described. Further, recesses 124 and 126 respectively comprise surfaces 128 and 130 which are generally inclined toward each other as to thereby define a generally medially disposed radially extending projection 132.

A detent or retainer like spring 134 having its opposite ends 136 and 138 respectively received as within recesses or slots 140 and 142 formed within housing section 24. A loop-like projection 144, carried generally by spring 134, operatively engages and seats within detent recess 112 or 114 depending upon the attitude to which member 90 has been positioned. When thusly seated or nested, spring means 134 is effective for maintaining that selected position of actuator 90 even if plunger member 56 is manually released to return to position 56', as previously described with reference to FIG. 1. A space-like chamber or relieved portion 146 is preferably provided in housing section 24 to accommodate therein a portion of spring means 134 when it is deflected downwardly, as viewed in FIG. 3, when actuator member 90 is rotated about pivot members 100 and 102 thereby causing projection 118 to pass past projection 144 as by pushing spring portion 144 downwardly. Actuator member 90 may be formed of any suitable material such as, for example, polycarbonate.

Figure 6:
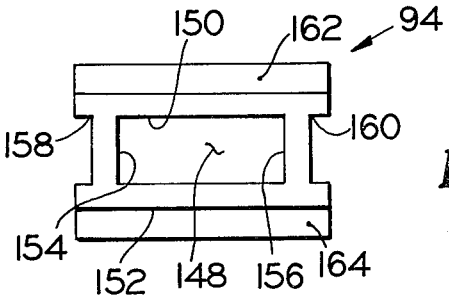
FIG. 6 is a bottom plan view taken generally on the plane of line 6—6 of FIG. 5 and looking in the direction of the arrows.
Figure 5:
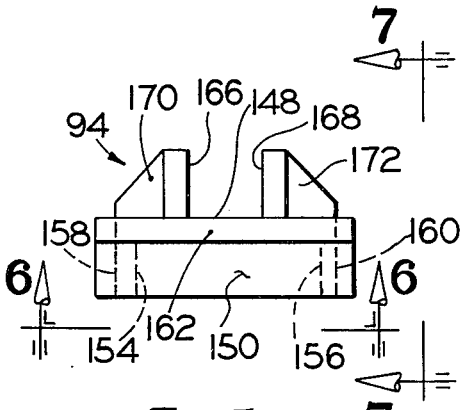
FIG. 5 is a side elevational view taken generally on the plane of line 5—5 of FIG. 4 and looking in the direction of the arrows.
Figure 7:
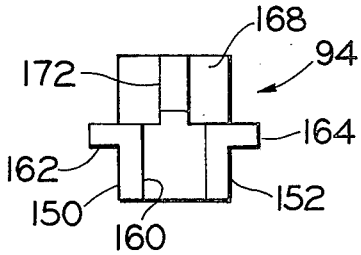
FIG. 7 is an end elevational view taken generally on the plane of line 7—7 of FIG. 5 and looking in the direction of the arrows.
Figure 8:
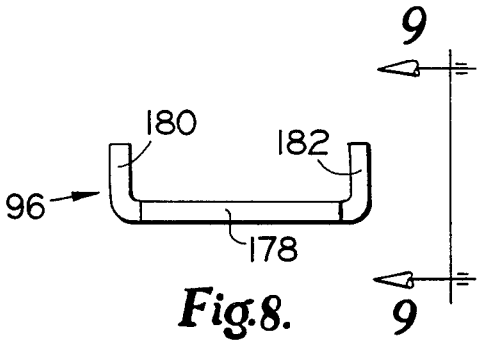
FIG. 8 is a side elevational view of one of the elements shown in FIGS. 1 and 2.
Figure 9:
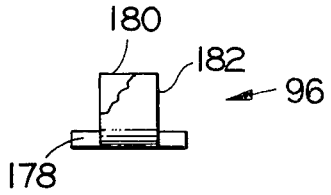
FIG. 9 is an end elevational view taken generally on the plane of line 9—9 of FIG. 8 and looking in the direction of the arrows.

As illustrated in FIGS. 1, 2, 4, 5, 6 and 7, the slider or contact block 94 may be molded, as of, for example, polycarbonate, as to comprise a main body portion 148 with downwardly depending side walls 150 and 152 and dowardly depending end walls 154 and 156. As best seen in FIG. 6, end walls 154 and 156 are preferably set generally inwardly from the ends of side walls 150 and 152 as to thereby define slot-like recesses 158 and 160 at opposite ends. Also, as best seen in FIGS. 6 and 7, side walls 150 and 152 are also set generally inwardly of the respective side edges of body portion 148 as to thereby define, generally outwardly of such side walls, laterally projecting longitudinally extending rail-like or guide portions 162 and 164. Vertically extending and spaced abutment type walls 166 and 168 are carried on the upper side of main body portion 148, as viewed in either FIG. 1, 2, 5 or 7. Such may be reinforced as by respective gussets 170 and 172. As shown in FIG. 2, and partly in FIG. 1, the rail portions 162 and 164 are respectively closely slidably received within cooperating guide slots or guide recesses 174 and 176 respectively formed in housing sections 24 and 22. As shown in FIG. 1, and partly in FIG. 2, the contoured end 108 of arm 192 is closely received between and generally contained by opposed spaced walls 166 and 168. As arm 92 is swung clockwise, as viewed in FIG. 1, end 108, through its operative engagement with wall 166, causes slider or contact block 94 to be moved to the left, as also viewed in FIG. 1, along the guide slots 176 and 174 (FIG. 2).

Referring to FIGS. 1, 2, 8 and 9, the movable electrical contact 96 is illustrating a generally flat plate-like main body portion 178 having integrally formed generally upwardly extending tab-like end portions 180 and 182 which, preferably, are narrower than the transverse width of body portion 178 and respectively closely received within and confined by recesses or slots 158 and 160 of contact block 94. Although contact 96 may be made of any suitable material, in the preferred embodiment contact 96 is comprised of relatively hard drawn copper.

As shown in FIGS. 1, 2 and 6, contact block 94 has a chamber or recess cooperatively defined as by end and side walls 150, 152, 154 and 156 which accommodates the reception therein of biasing spring means 184 which, in the preferred embodiment, comprises a spring of generally semi-eliptical configuration comprised of, for example, beryllium copper. The function of such spring means 184 is to continually resiliently urge contact 96 away from contact block 94 and towards the related relatively stationary or fixed electrical contacts.

Figure 10:
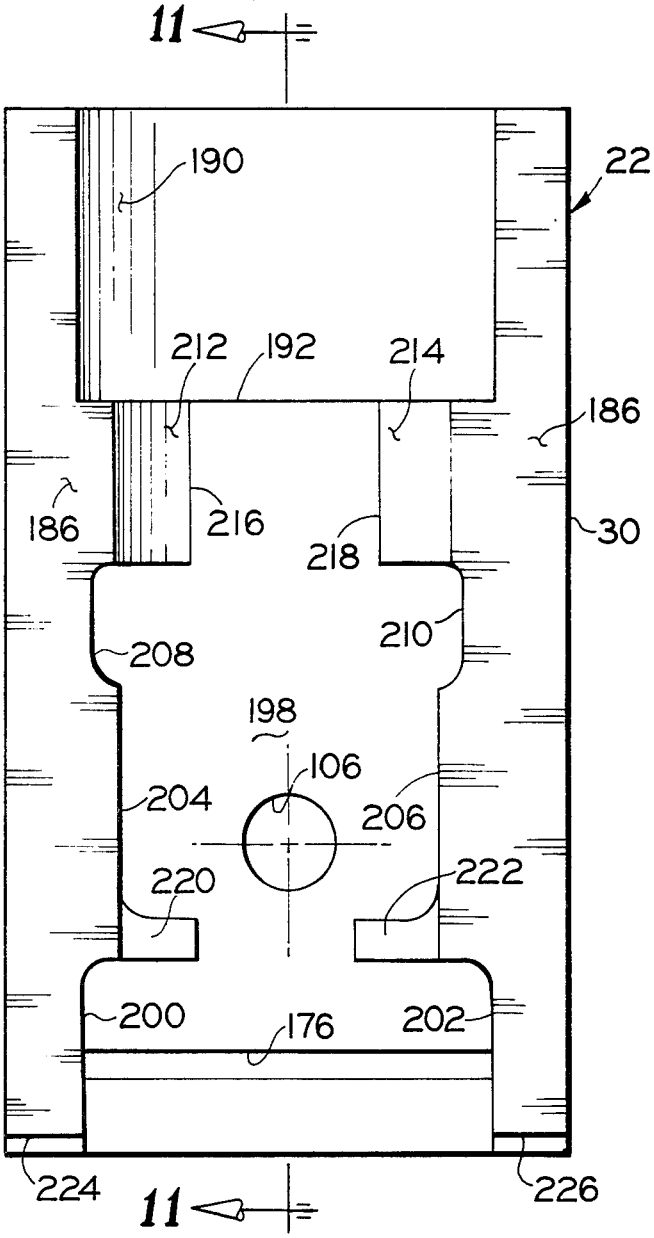
FIG. 10 is an elevational view of one of the elements shown in FIG. 1 and in the same position as illustrated therein.
Figure 11:
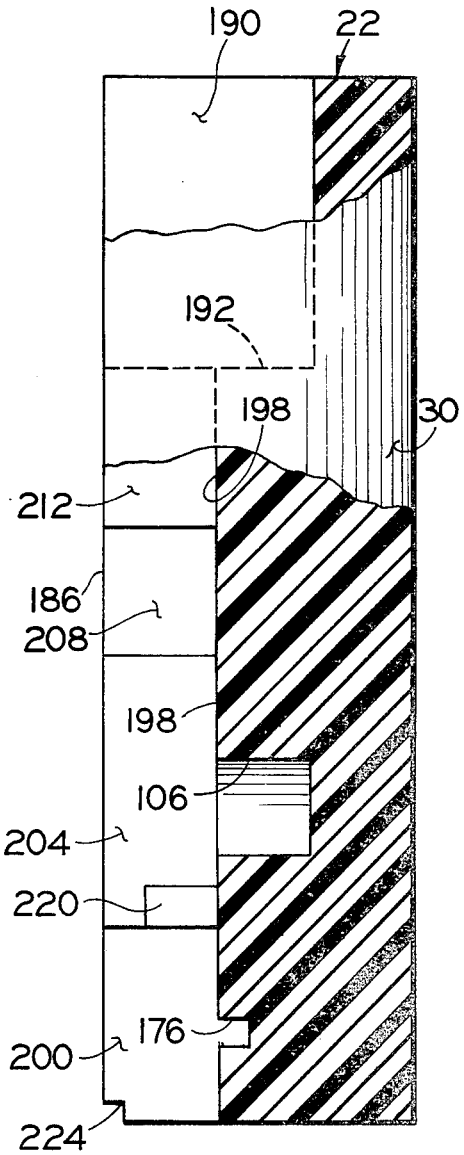
FIG. 11 is a cross-sectional view taken generally on the plane of line 11—11 of FIG. 10 and looking in the direction of the arrows.

FIG. 10 is a view of housing section 22 shown in the same position as shown in FIG. 1 and without the other elements shown in FIG. 1 while FIG. 11 is a cross-sectional view, taken on the plane of line 11—11 of FIG. 10, with a portion thereof shown in elevation. More particularly, housing section 22 along with housing section 24 (FIGS. 2, 3, 12 and 13) cooperate to form body means for housing and supporting the various elements as hereinbefore described and as will be described. That is, each of such sections 22 and 24 is, generally, a half-cylinder. For example, housing section 22 has an axially extending parting-like surface or abutment face 186 which becomes juxtaposed to a similar axially extending parting-like surface or abutment face 188 formed on housing section 24 (FIG. 12) when such housing sections 22 and 24 are assembled and contained within outer housing means 20.

Referring to both housing sections 22 and 24 of FIGS. 10–13, the upper end of section 22 is provided with a semi-circular recess-like portion 190 having an axial inner end surface 192 while the upper end of section 24 is similarly provided with a semi-circular recess-like portion 190 having an axial inner end surface 192 while the upper end of section 24 is similarly provided with a semi-circular recess-like portion 194 having an axial end surface 196. A planar surface 198, formed in housing section 22, extends generally longitudinally and, in the preferred embodiment, is parallel to the plane of surface 186. As can be seen in both FIGS. 10 and 11, the guide slot 176 is formed into such surface 198. First generally parallel, spaced and opposed side walls or surfaces 200 and 202, generally normal to surface 198, extend from surface 186 to inner planar surface 198; second generally parallel, spaced and opposed side walls or surfaces 204 and 206, also generally normal to surface 198, extend from surface 186 to inner planar surface 198 with such surfaces 204 and 206 being spaced from each other a distance less than the distance between side walls or surfaces 200 and 202; similarly, third generally parallel, spaced and opposed side walls or surfaces 208 and 210, also normal to surface 198, extend from surface 186 to inner planar surface 198. As depicted surfaces 208 and 210 are spaced from each other a distance greater than that of surfaces 204 and 206. Further, as illustrated, such pairs of side walls or surfaces may be effectively joined to each other as by shoulder-like or generally transverse surface segments. At an area generally axially between end surface 192 and side walls or surfaces 208 and 210, housing section 22 is provided with axially extending cylindrical surface segments 212 and 214. The center of revolution of such segments 212 and 214 would lie in the plane of surface 186 so that cylindrical segments 212 and 214 would respectively intersect the plane of planar surface 198 as indicated by lines 216 and 218 thereby resulting in that portion of planar surface 198 between cylindrical segments 212 and 214 forming a chordal plane thereof. In the preferred embodiment, a pair of opposed flange-like or arm-like portions 220 and 222 integrally formed with and extending from surface 198 and respectively integrally formed with and extending from wall surfaces 204 and 206 are provided as to define a preselected clearance space therebetween. Also, in the preferred embodiment, suitable keying means is provided for keying housing sections 22 and 24 as to the end housing section 28. For example, such keying means, in housing section 22, may take the form of aligned key slot portions 224 and 226 which cooperate with similar key slot portions 228 and 230 of housing section 24 when, as previously described, such housing sections 22 and 24 are assembled to each other.

Figure 13:
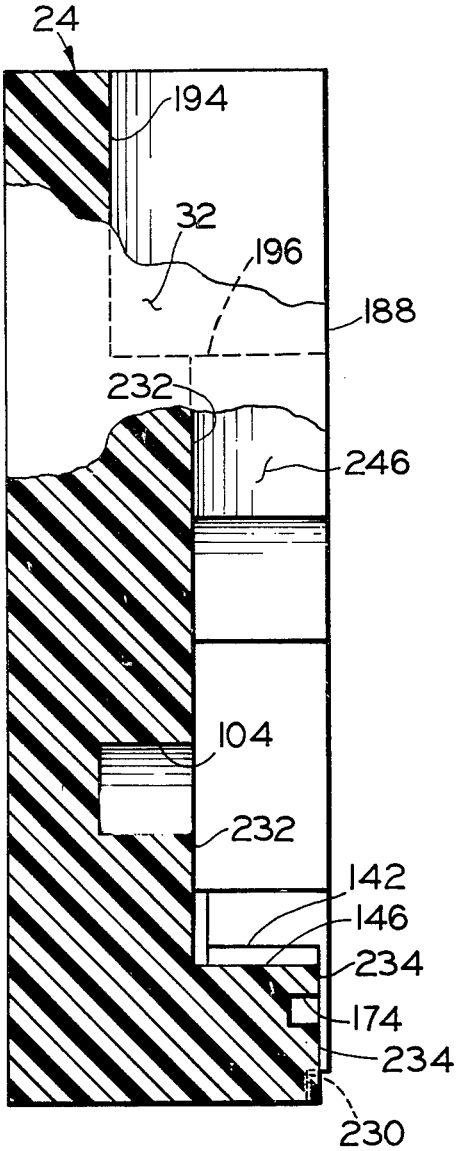
FIG. 13 is a cross-sectional view taken generally on the plane of line 13—13 of FIG. 12 and looking in the direction of the arrows.
Figure 12:
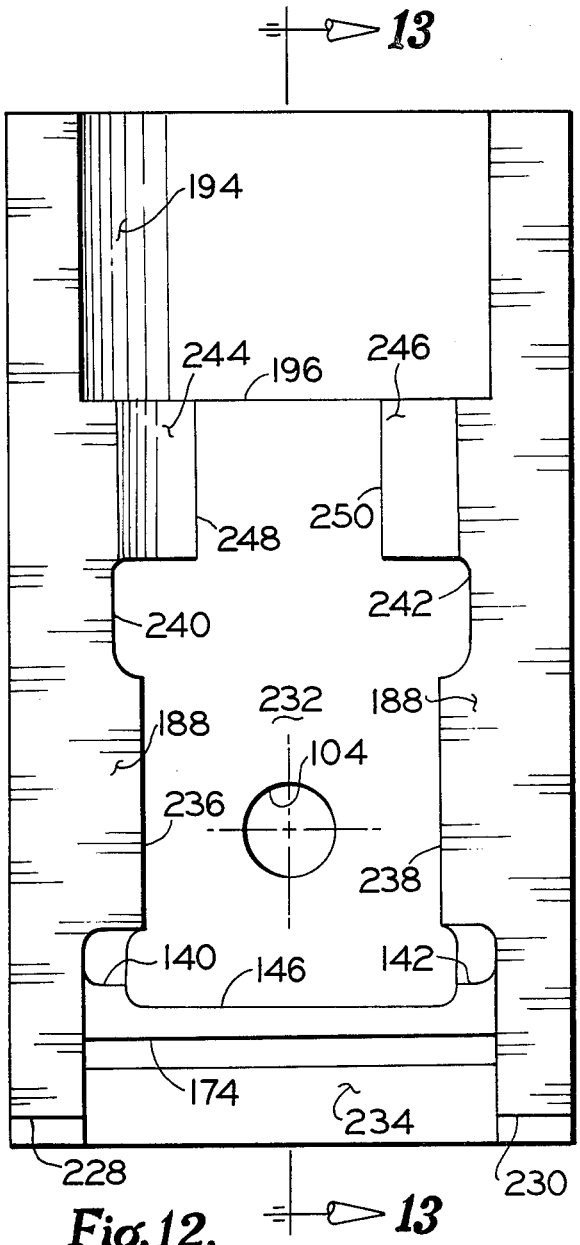
FIG. 12 is an elevational view, of one of the elements shown in FIGS. 2 and 3, taken generally on the plane of line 12—12 of FIG. 2 and looking in the direction of the arrows.

Referring in greater detail to FIGS. 12 and 13, a planar surface 232, formed in housing section 24, extends generally longitudinally and, in the preferred embodiment, is parallel to the plane of surface 188. A second planar 234 is formed generally at the lower end of housing section 24 as to also be parallel to surface 188 and slightly spaced, generally inwardly, therefrom. By providing such an additional surface 234 it can be assured that there will be no interfering binding action on the movement of contact block or slider 94 regardless of how tightly housing sections 22 and 24 are brought together by outer housing 20. As can be seen in both FIGS. 12 and 13, guide slot 174 is formed into such surface 234. First generally parallel, spaced and opposed side walls or surfaces 236 and 238, generally normal to surface 232, extend from surface 188 to inner planar surface 232 while second generally parallel, spaced and opposed side walls or surfaces 240 and 242, also generally normal to surface 188, extend from surface 188 to planar surface 232. Walls 236 and 238 are so located as to be aligned with walls 206 and 204, respectively, when sections 22 and 24 are functionally assembled and, similarly, the location of walls 240 and 242 is such as to have them be aligned, respectively, with walls 210 and 208 of section 22 during such an assembled condition. At an area generally axially between end surface 196 and side walls 240 and 242, housing section 24 is provided with axially extending cylindrical segments 244 and 246. The center of revolution of such segments 244 and 246 would lie in the plane of surface 188 so that cylindrical segments 244 and 246 would respectively intersect the plane of planar surface 232 as indicated by lines 248 and 250 thereby resulting in that portion of planar surface 232 between cylindrical segments 244 and 246 forming a chordal plane thereof. When such housing sections 22 and 24 are brought together in assembled relationship cylindrical half-sections or half-portions 194 and 190 become juxtaposed and cooperatively define a functionally cylindrical bore 252 which slidably receives the radiating flange 254 of tubular member 66 (FIG. 1), while cylindrical segments 212 and 246 define, functionally, one continuous cylindrical surface segment and cylindrical segments 244 and 214 define, functionally, a second oppositely disposed continuous cylindrical surface segment. Between such opposed continuous cylindrical surface segments are, on one diametral side, the chordal plane portion of planar surface 198 and, on the diametrally opposite side, the chordal plane portion of planar surface 232. Therefore, if viewed from, for example, the upper axial end, segments 212, 214, 244 and 246 would appear as defining a circular configuration with two opposed flatted or chordal portions. As will become apparent, such flatted or chordal portions comprise keying means.

Figure 16:
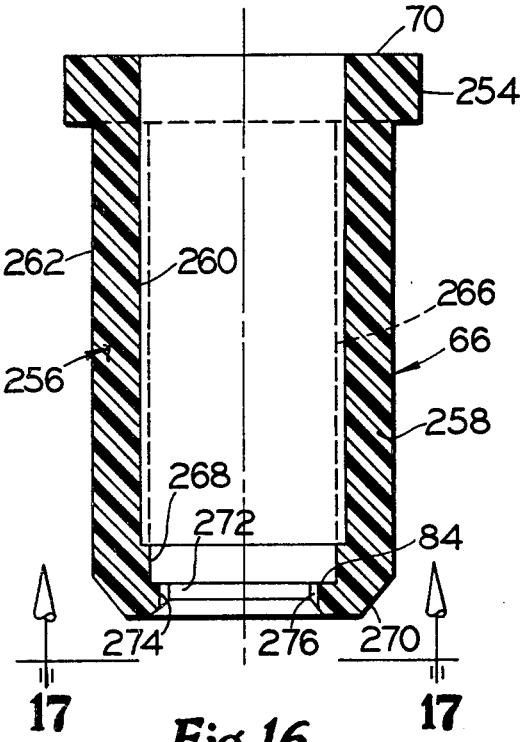
FIG. 16 is an axial cross-sectional view of one of the elements shown in FIG. 1 and in the same position as illustrated therein.
Figure 17:
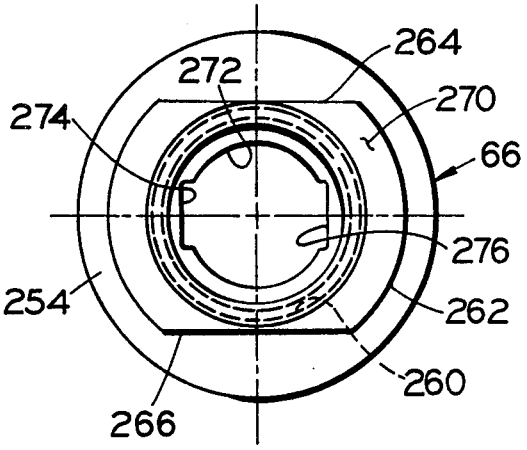
FIG. 17 is an end elevational view taken generally on the plane of line 17—17 of FIG. 16 and looking in the direction of the arrows.

Referring in greater detail to FIGS. 16 and 17, the generally cylindrical tubular member 66 is illustrated as comprising a main body 256 comprised, in turn, of an annular wall 258 which has a cylindrical inner surface 260 and an outer cylindrical surface 262 interrupted as by opposed axially extending flat surfaces 264 and 266 which, at their respective upper ends terminate as in the annular radiating flange portion 254. The lower end, generally, has a relatively smaller inner diameter counterbore 268 formed therein and terminating as in the annular end wall or flange-like surface 84. The outer lower end may be provided with a chamfered portion as at 270. An end passage or bore 272 enables the extension therethrough of resiliently deflectable member 72 (FIG. 1) and, preferably, notch-like enlargements 247 and 276 are provided in opposite sides of bore 272 as to better accommodate certain portions of member 72.

Figure 18:
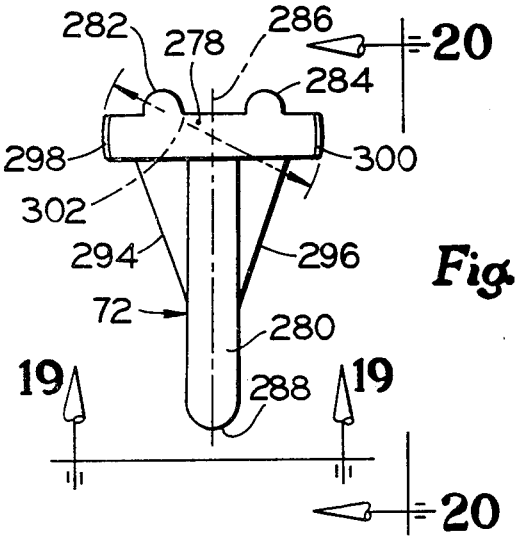
FIG. 18 is a side elevational view of one of the elements shown in FIG. 1 but positioned in an attitude unlike that illustrated in FIG. 1.
Figure 20:
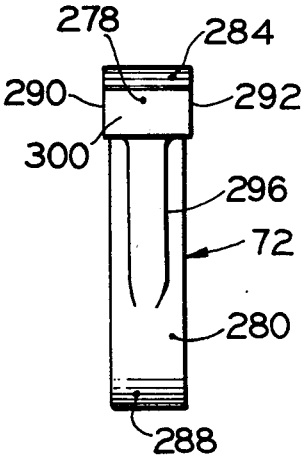
FIG. 20 is a side elevational view taken generally on the plane of line 20—20 of FIG. 18 and looking in the direction of the arrows.
Figure 19:
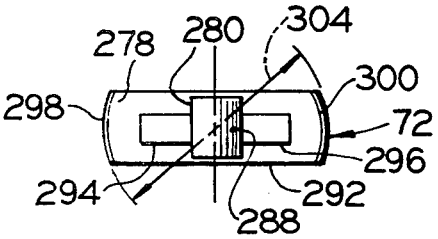
FIG. 19 is a bottom end plan view taken generally on the plane of line 19—19 of FIG. 18 and looking in the direction of the arrows.

Referring in greater detail to FIGS. 18, 19 and 20, the member 72, which may be formed of any suitable material such as, for example, polycarbonate, is illustrated as comprising a main generally transverse body portion 278 with an integrally formed, generally medially disposed, downwardly depending motion transmitting portion or extension 280. At the upper side of body 278, generally arcuate abutment or rocker portions 282 and 284 are provided as to be spaced from each other and on opposite sides of the related medial axis 286. As is best seen in FIG. 18, rocker portions 282 and 284 along with the lower end 288 of extension 280 are preferably formed as to have the outer surfaces thereof arcuate or cylindrical with the respective axes of generation thereof being parallel to each other and normal as to opposed side surfaces 290 and 292 of body 278. Gusset-like portions 294 and 296 are respectively located on opposite sides of extension 280 and are preferably integrally formed with both the extension 280 and body 278. The gusset portions 294 and 296, in addition to providing reinforcement to extension 280, provide a piloting means for spring means 82 (FIG. 1) thereby assuring the proper relative location of the upper end of spring 82 in relation to body 278. As generally depicted in FIGS. 18 and 19, ends 298 and 300 of body 278 are generally spherical-like segments determined as by the diameter 302 of FIG. 18 and diameter 304 of FIG. 19 wherein, such diameters may actually be identical. In any event, such contoured end surfaces 298 and 300 enable member 72 to assume the generally inclined position depicted in FIG. 1 while still keeping the ends 298 and 300 closely confined by the inner cylindrical surface 260 of tubular member 66.

Referring in particular to FIGS. 1, 14, 15 and 20, member 72, when assembled as generally shown in FIG. 1, has its body 278 generally received by slot 78 in a manner as to have its sides 290 and 292 closely confined thereby.

As generally shown in FIGS. 1 and 2, the body of lower housing section 28 has a generally relieved or recess-like portion 306 formed into the axially inner surface thereof and projections 308 and 310 formed thereon and comprising keying means. That is, when housing sections 22 and 24 are assembled to each other, juxtaposed cut-outs or notches 224 and 230 cooperate to define a first keying slot effective for receiving and containing keying projection 308 while respective juxtaposed notches 226 and 228 cooperate to define a second keying slot effective for receiving and containing keying projection 310. Such keying means assure that end housing section 28 will be assembled in a prescribed manner thereby resulting in the proper working relationship among the related elements. Further, the keying means may be such, as by differing configurations or sizes, as to preclude assembly of housing section 28 in a position rotated 180° from that as depicted. It should be apparent that the practice of the invention is not limited to the precise keying or indexing means disclosed.

A plurality of slots or passages 312, 314 and 316 are formed through the body of housing section 28 as to closely receive therethrough, respectively, electrical conductor or terminal means 318, 320 and 322. The respective upper ends 324, 326 and 328 of such terminal means are formed over and against surface 306 as to thereby define fixed or stationary electrical contacts while tab-like portions 330, 332 and 334, struck from the terminal means, are formed over and against the under or outer axial end surface of housing section 28 in order to thereby provide a mechanical lock against movement of said terminal means relative to housing section 28.

OPERATION OF INVENTION

As is apparent in view of the preceding, when the various elements disclosed and described are assembled as into the assembly depicted as by FIGS. 1, 2 and 3, the toggle-like lever means 90 is pivotally supported at both sides thereof as by pivot bearing means 104, 100 and 106, 102 thereby assuring the type and degree of support needed to result in a long useful life of such a switch assembly.

Referring now in greater detail to FIGS. 1, 2 and 3, let it be assumed that manual control of the plunder means 54 has been terminated and that such means is now in its upper-most position as generally depicted at 56'. In such an assumed condition end 288 of resiliently deflectable member 72 will be at some position above rocker member 90 and spring 82 will have caused such member 72 to assume a generally vertically positioned attitude by virture of rocker or pivot-like abutment portions 282 and 284 each abutting against the bottom (or as viewed in FIG. 1, the top) of slot or recess 78. Lever or rocker means 90 will be maintained in the position depicted in FIGS. 1 and 3 as by the operative engagement between spring means 134 and detent recess 112 (FIG. 3). This, in turn, will keep movable contact 96 (FIG. 1) in the position depicted electrically bridging and contacting electrical contacts 326 and 328.

If now it is assumed that the manually actuated plunger member 56 is being moved inwardly of the assembly 10 (downwardly as viewed in FIG. 1), tubular portion 66 and resiliently deflectable actuator 72 are also then moved downwardly, against the resistance of spring 86, with such movement continuing until end 288 of vertically extending portion 280 contacts the ramp-like surface 130 (also see FIG. 3) of projection 132 of the rocker motion transmitting means 90. Further downward movement of plunger 56, tubular extension 66 and deflectable member 72 results in end 288 being gradually deflected to the right (as viewed in FIG. 1) with such end 288 maintaining sliding engagement with surface 130 until such time as end 288 reaches the general apex of notch or recess 126. If further downward movement is continued, the force thereof is transmitted through member 72 and arm 122 of rocker member 90 causing a sufficient force to be exhibited resulting in clockwise rotation of member 90 with extension or projection 118 (FIG. 3) deflecting spring 134 downwardly. It should be apparent that as projection 118 thusly passes past the center of deflection of spring 134, portion 144 will engage the oppositely inclined ramp-like surface of notch or detent recess 114 and, because of its spring force, cause a snap-like action to occur resulting in a rapid clockwise rotation of means 90 as to have spring portion 144 become seated within recess 114 and the axis 116 of means 90 attaining an attitude equally and oppositely inclined to that depicted in FIGS. 1 and 3. As a consequence of such rotation by motion transmitting means 90, lever portion 92 thereof causes contact block 94 and contact 96 to move to the left (as viewed in FIG. 1), sliding along guide slots 176 and 174 (FIGS. 1 and 2), as to contact and electrically bridge contacts 326 and 324. As is best seen in FIG. 1, flange-like portions 220 and 222 serve as abutments against which, respectively, arms 120 and 122 may abut as to thereby provide for a stop or maximum movement for the actuating means 56, 66 and 72 without requiring that the force thereof be either transmitted through or absorbed by the pivot means 100, 104 and 102, 106 or the contact block 94 or contacts 96, 328, 326, and 324. If the plunger member 56 is again released, spring 86 will return members 56, 66 and 72 to their previous uppermost position while spring 134 maintains rocker means 90 and contact 96 in the newly established leftmost position. If the plunger member 56 is then again moved inwardly, the sequence of events described is repeated except that end 288 engages ramp surface 128 of detent recess 124 and the rocker means 90 is consequently rotated counter-clockwise ultimately resulting in member 90 and contact block 94 and contact 96 assuming positions as depicted in FIGS. 1, 2 and 3.

Figure 21:
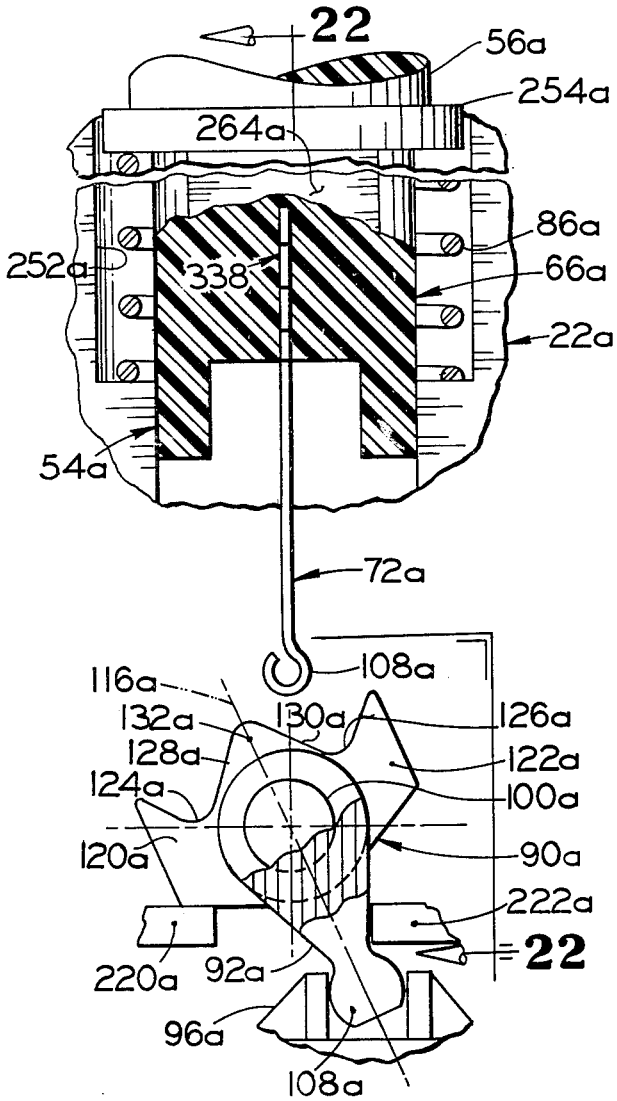
FIG. 21 is a view somewhat similar to that of FIG. 1, with various elements and/or details not shown, illustrating a modification of the invention.
Figure 22:
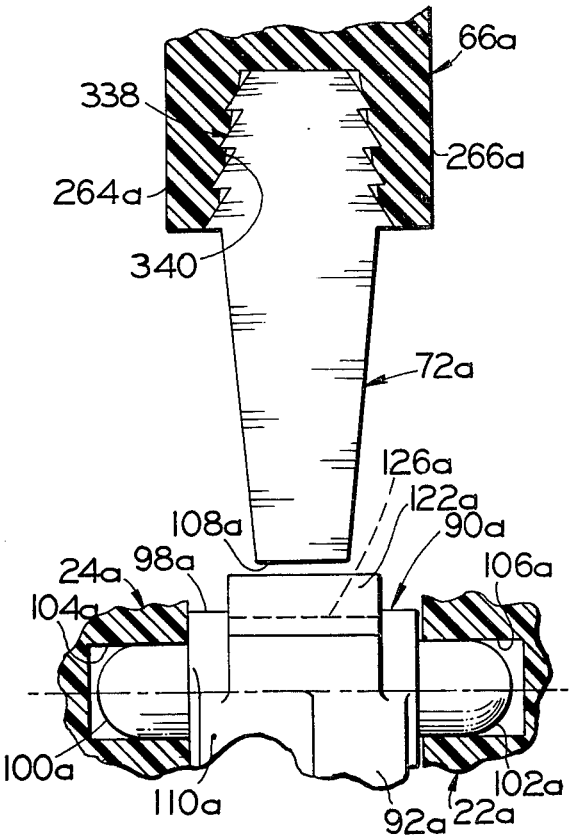
FIG. 22 is a view taken generally on the plane of line 22—22 of FIG. 21 and looking in the direction of the arrows.

FIGS. 21 and 22, views somewhat similar to those of FIGS. 1 and 2, illustrate a modification of the invention. All elements shown in FIGS. 21 and 22 which are like or similar to those of preceding Figures are identified with like reference numbers provided with a suffix "a". Only so much of the structure of the modification is illustrated as is necessary to a complete understanding thereof. Other elements not shown in FIGS. 21 and 22 may be assumed to be as generally depicted in preceding Figures.

Referring now in greater detail to FIGS. 21 and 22, it can be seen that the resiliently deflectable member **72*a* comprises a spring member, which as shown may be of generally flat stock, having a generally rounded or cylindrical portion 108*a* formed at the lower end thereof and securing means, such as a barbed or christmas-tree configurated upper end 338 retained as within an accommodating slot or recess 340 formed in the portion 66*a*. As generally depicted, if desired, members 56 and 66 of FIG. 1 may be considered as finding their functionally equivalent counterparts in portions 56*a* and 66*a* of a single member 54*a* of FIG. 21**.

The operation of the modification of FIGS. 21 and 22 is as that already described with reference to FIGS. 1 and 2. That is, when actuated inwardly or downwardly end **108*a* engages either ramp surface 130*a* or 128*a* (depending upon the then position of wiper contact drive means 90*a*) and the bottom of such drive member 72*a* is deflected outwardly toward the related recess, that is, either recess 126*a* or 124*a*. Further downward movement of the deflectable drive member 72*a* results in rotation of the means 90*a*** previously described.

Figure 23:
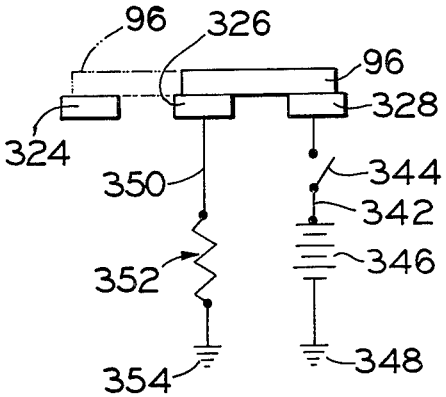
FIGS. 23 and 24 are each simplified schematic diagrams typically and by way of example illustrating, respectively, different electrical circuits in which a switch embodying teachings of the invention can be employed.
Figure 24:
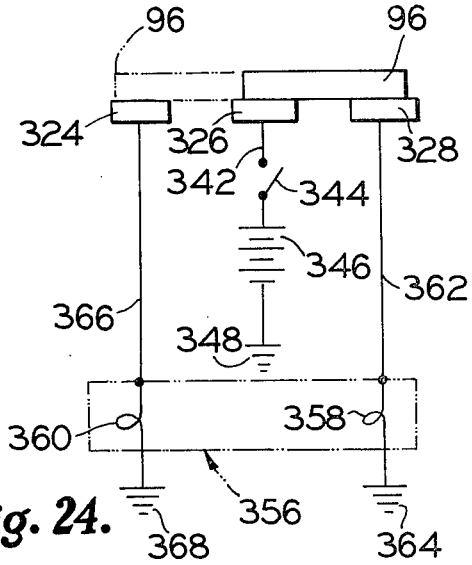

FIGS. 23 and 24 are each simplified generally schematic diagrams illustrating ways in which the switch of the invention may be employed with related electrical circuitry. FIG. 23 illustrates an arrangement wherein the fixed or relatively stationary contact 328 is electrically connected as via conductor means 342, which may comprise switch means 344, to a related source of electrical potential 346 which, at its other electrical side is grounded as at 348. Switch means 344 may be a master type switch as, for example, the key operated ignition switch assembly within an automotive vehicle which, in turn, functions to complete various circuits as between a secondary switch device and an electrical source such as 346. Contact 326 is shown as being electrically connected via conductor means 350 to related electrical load means 352, which may be grounded as at 354, while contact 324 is shown as not being connected to any related operative electrical circuitry. Accordingly, with switch means 344 closed and movable contact 96 being in the position shown, an electrical circuit is completed from source 346, through contact 328, contact 96, contact 326, conductor means 350, electrical load 352 and back to ground 354, 348. However, when, as previously described, contact 96 is moved to the left (depicted in phantom line) as to bridge contacts 324 and 326 the circuit, through contact 328, to the source of electrical potential is opened and, consequently, the energization of load means 352 is terminated. Accordingly, FIG. 23 illustrates, typically, an application of a switch embodying teachings of the invention employed in its "Push-on, Push-off" mode of operation.

Referring to FIG. 24, it can be seen that instead of contact 328, it is contact 326 which is connected to the source of electrical potential 346 while both contacts 324 and 328 are electrically connected to related electrical load means 356. For purposes of illustration, load means 356 may be considered as being an automotive headlamp comprising what is commonly referred to as a "lower beam" filament 358 and an "upper beam" filament 360. Contact 328 is shown as being electrically connected to one electrical side of filament or load 358 as by conductor means 362 while the other electrical side is grounded as at 364. Similarly, contact 324 is shown as being electrically connected to one electrical side of filament or load 360 as by conductor means 366 while the other electrical side is grounded as at 368. With switch means 344 closed and contact 96 in the position shown, an electrical circuit is completed from source 346 through contact 326, contact 96, contact 328, conductor means 362, electrical load 358 and back to ground 364, 348. When contact 96 is moved to the left, as depicted in phantom line, the circuit from contact 326 to contact 328 is opened and a new circuit is completed from source 346 through contact 326, contact 96, contact 324, conductor means 366, electrical load 360 and back to ground 368, 348. Accordingly, FIG. 24 illustrates, typically, an application of a switch embodying teachings of the invention employed in its "Push-on, Push-on" mode of operation.

It has further been discovered that unexpected benefits are derived by employing a movable contact of a configuration other than have a single flat contacting surface. FIGS. 25–32 illustrate, by way of example, certain specific and preferred embodiments of such movable contacts. All elements in FIGS. 25 and 26 which are like or similar to those of preceding Figures are identified with like reference numerals provided with a suffix "b"; all elements in FIGS. 27 and 28 which are like or similar to those of preceding Figures are identified with like reference numerals provided with a suffix "c"; all elements in FIGS. 29 and 30 which are like or similar to those of preceding Figures are identified with like reference numerals provided with a suffix "d" and all elements in FIGS. 31 and 32 which are like or similar to those of preceding Figures are identified with like reference numerals provided with a suffix "f".

Figure 25:
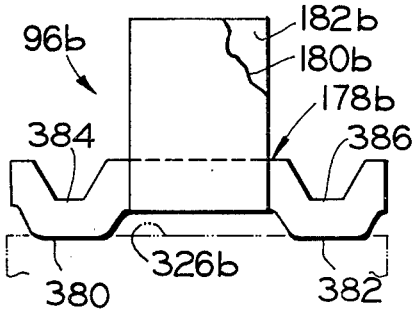
FIGS. 25 and 26 are respectively end and side elevational views, in relatively enlarged scale, illustrating a modification of one of the elements shown in preceding Figures.
Figure 26:
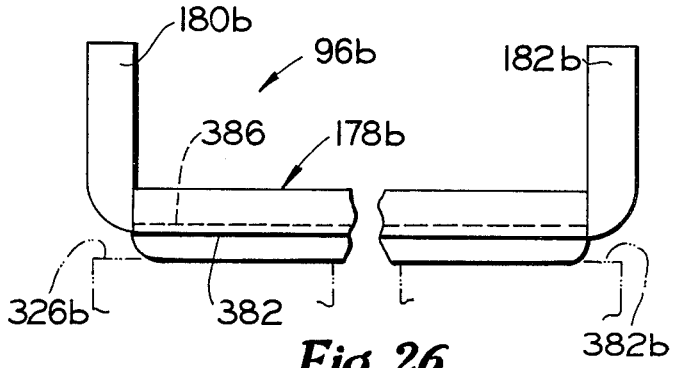

Referring now in greater detail to FIGS. 25 and 26, the contact **96*b* is illustrated as comprising a main contact body 178*b* with upwardly directed tab-like retainers 180*b* and 182*b* carried thereby at opposite ends thereof. The body 178*b*, in turn, is formed as to define runner-like contact surfaces 380 and 382 which are spaced from each other. This may be accomplished as by forming the body 178*b* as to create upper channel like portions 384 and 386 which consequently result in the lower disposed runner-like contact surfaces. As generally depicted, the contact surfaces 380 and 382 rest against the surface (or surfaces) of the cooperating relatively stationary contact means, such as 326*b* and 328*b*, as to, generally, slide longitudinally when the contact 96*b* is moved as described with reference to the preceeding Figures. As shown in FIG. 25, the effective contacting width of runner-like contact portions 380 and 382 is relatively small compared to the overall width of body 178*b***.

Figure 27:
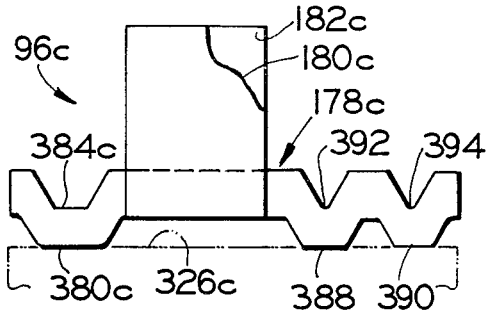
FIGS. 27 and 28 are views respectively similar to FIGS. 25 and 26 and illustrating a further modification of said element.
Figure 28:
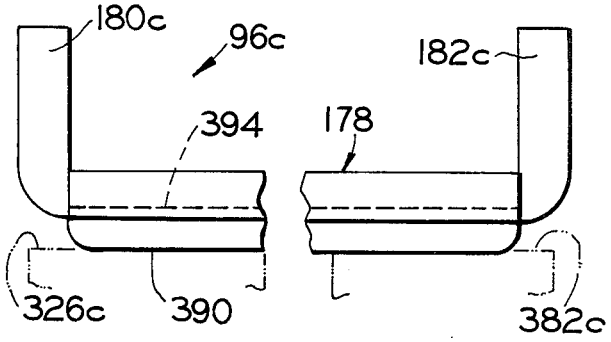

Referring to FIGS. 27 and 28, the contact **96*c* is illustrated as having, at generally one side of body 178*c*, a single runner-like contact surface 380*c* and, at the other side of body 178*c*, a plurality of longitudinally extending runner-like contact surfaces 388 and 390 which, similarly, may be formed as the result of upper formed channel-like portions 392 and 394. As shown in FIG. 27, the effective contacting width of each of runner-like contact portions 388 and 390 is relatively small compared to the overall width of body 178*c***.

Figure 29:
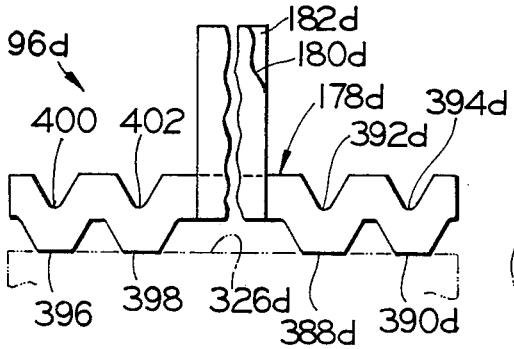
FIGS. 29 and 30 are views respectively similar to FIGS. 25 and 26 and illustrating another modification of said element.
Figure 30:
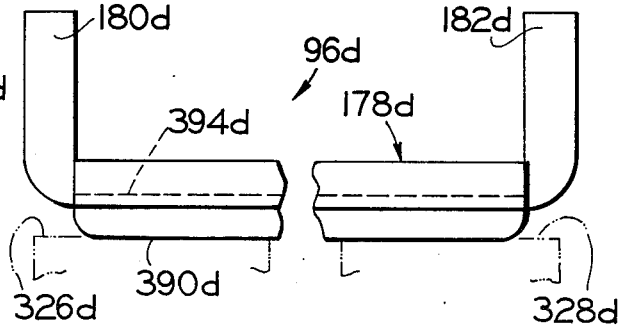

Referring to FIGS. 29 and 30, the contact **96*d*, especially compared to contact 96*c* of FIGS. 27 and 28, is shown as being changed as by having its left side, as viewed in FIG. 29, effectively the mirror image of the right side in that a plurality of spaced runner-like contact portions 396 and 398 are provided as by forming upper disposed channel-like portions 400 and 402. Again, as shown in FIG. 29, the effective width of each of the runner-like contact portions 396, 398, 388*d* and 390*d* is relatively small compared to the overall effective width of body 178*d***.

Figure 31:
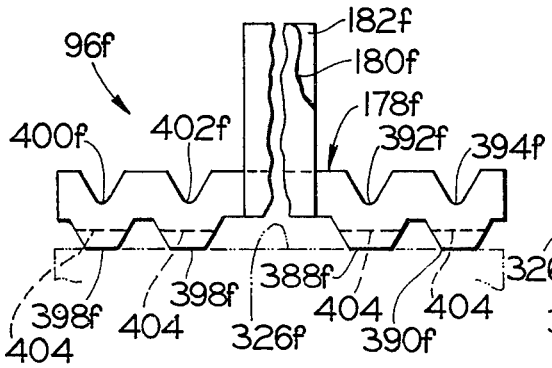
FIGS. 31 and 32 are views respectively similar to FIGS. 25 and 26 and illustrating a still further modification of said element.
Figure 32:
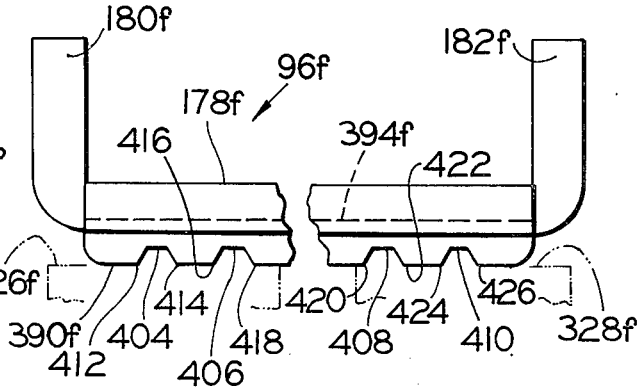

FIGS. 31 and 32 illustrate a further modification in that the generally longitudinally extending contact portions are further provided with a plurality of generally transversely directed slots or grooves, such as at 404, 406, 408, and 410, which, in turn, provide a plurality of edges, as at 412, 414, 416, 418, 420, 422, 424 and 426.

With contacts as depicted by any of FIGS. 25–32, it has been discovered that extremely long useful contact life is attained with extremely little increase in resistance occurring across coacting contacts due to the atmospheric conditions as well as metal transference due to arcing and the like. What the contacts of FIGS. 25–32 provide is for redundant flow paths for the current. That is, for example referring to FIGS. 25 and 26, if the stationary contacts **326*b* and/or 328*b* should start to experience corrosion in the area over which contact portion 380 is sliding, any potentially resulting increase in resistance is not experienced in the circuitry because the other redundant flow path defined by runner-like contact portion 382 provides for a lower resistance to current flow and such path will then become the current carrying path. While contact portion 382 continues to serve as the primary current path, with each movement of contact member 96*b*, the other runner-like portion 380 continues to frictionally slide against the cooperating fixed contacts and in so doing scrapes and polishes the surface thereof thereby removing the assumed corrosion. The same interaction as among the various runner-like contact portions occurs in all of the embodiments of FIGS. 25–32. The further modification of FIGS. 31 and 32, wherein the additional generally transverse grooves or slots are formed, provides additional generally transversely directed edges (412 etc) which further enchance the cleaning action of such runner-like contact portions as they rub against the coacting contact members. In certain successful embodiments of contacts according to FIGS. 25–32, the effective contacting width of the runner-like contacting portions (as viewed in any of FIG. 25, 27, 29 or 31**) has been as small as in the order of 0.025 inch.

Although only a preferred embodiment and selected modification of the invention have been disclosed and described, it is apparent that other embodiments and modifications of the invention are possible within the scope of the appended claims.

I claim:

1. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first operating positions to an other of said first operating positions, said manually movable actuator means comprising plunger-like means axially movable in directions generally toward and away from said oscillatingly movable motion transmitting means, and keying means for the otherwise free rotational movement of said plunger-like means relative to said switch body means as said plunger-like means moves axially in said directions generally toward and away from said oscillatingly movable motion transmitting means, said keying means comprising a first keying portion carried by said plunger-like means and a second keying portion carried by said switch body means.

2. An electrical switch assembly according to claim 1 wherein said resiliently deflectable motion transmitting means comprises an elongated spring-like member deflectable only in directions generally transverse to the longitudinal axis thereof.

3. An electrical switch assembly according to claim 1 wherein said movable contact means comprises a contact main body, said main body carrying generally linearly extending contacting surfaces effective for sliding contacting engagement with said plurality of stationary electrical contacts, and said contacting surfaces being spaced from each other and projecting generally away from said main body.

4. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first operating positions to an other of said first operating positions, said switch body means comprising a plurality of separable switch body sections, outer housing means situated generally about said plurality of separable switch body sections and containing said plurality of separable switch body sections in assembled relationship, said plurality of separable switch body sections comprising first and second relatively elongated body sections each of which has an outer semi-cylindrical surface and each of which also comprises first and second relatively elongated parting-like surfaces, the axis of revolution of each of said semi-cylindrical surfaces being generally parallel to said parting-like surfaces, said first and second relatively elongated body sections when assembled to each other causing said first and second parting-like surfaces of said first body section to be respectively juxtaposed to said first and second parting-like surfaces of said second body section, said plurality of separable switch body sections further comprising a first end body section situated at one end of said first and second relatively elongated body sections and effective for at least partly receiving therethrough said movable actuator means, a second end body section situated at a second end of said first and second relatively elongated body sections opposite to said one end of said first and second relatively elongated body sections, said outer housing means being effective to radially contain said first and second relatively elongated body sections operatively against each other and to axially contain said first and second end body sections respectively against said one and said second ends of said first and second relatively elongated body sections, and indexing means, said indexing means comprising a first indexing portion carried by said second end body section and a second indexing portion carried by at least one of said first and second relatively elongated body sections, said first and second indexing portions being effective to said second end body section to be assembled to said second end of said first and second relatively elongated body sections in only a predetermined relationship.

5. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first operating positions to an other of said first operating positions, said resiliently deflectable motion transmitting means comprising a motion transmitting member at least partly confined by said movable actuator means as to be extending therefrom and towards said oscillatingly movable motion transmitting means, said motion transmitting member comprising first and second ends, said first end of said motion transmitting member being effective for engaging said oscillatingly movable motion transmitting means, said second end of said motion transmitting member being effective for abutingly engaging said movable actuator means, said second end of said motion transmitting member comprising first and second pivotal abutment portions spaced from each other and each being effective for enabling said motion transmitting member to undergo a rocking motion thereabout and with respect to said movable actuator means, and spring means carried by said movable actuator means and resiliently urging said motion transmitting member toward engagement with said movable actuator means with both of said first and second pivotal abutment portions.

6. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first operating positions to an other of said first operating positions, said resiliently deflectable motion transmitting means comprising a motion transmitting member at least partly confined by said movable actuator means as to be extending therefrom and towards said oscillatingly movable motion transmitting means, said motion transmitting member comprising first and second ends, said first end of said motion transmitting member being effective for engaging said oscillatingly movable motion transmitting means, said second end of said motion transmitting member being effective for abutingly engaging said movable actuator means, said second end of said motion transmitting member comprising first and second pivotal abutment portions spaced from each other and each being effective for enabling said motion transmitting member to undergo a rocking motion thereabout and with respect to said movable actuator means, first spring means carried by said movable actuator means and resiliently urging said motion transmitting member toward engagement with both of said first and second pivotal abutment portions against said movable actuator means, said manually movable actuator means comprising plunger-like means axially movable in directions generally toward and away from said oscillatingly movable motion transmitting means, and second spring means carried by said switch body means, said second spring means operatively engaging and urging said plunger-like means in one of said directions generally away from said oscillatingly movable motion transmitting means.

7. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first operating positions to an other of said first operating positions, said oscillatingly movable motion transmitting means comprising a pivotally mounted body member, said body member comprising first and second pivot members carried thereby and coaxially extending therefrom in directions opposite to each other, first and second journal portions carried by said switch body means effective for respectively supporting said first and second pivot members, said pivotally mounted body member comprising first and second abutment portions disposed eccentrically with respect to the coaxial pivotal axes of said first and second pivot members, said first abutment portion being operatively engaged by said resiliently deflectable motion transmitting means when said resiliently deflectable motion transmitting means is effective in moving said oscillatingly movable motion transmitting means from said one of said second plurality of operating positions toward said other of said second plurality of operating positions, said resiliently deflectable motion transmitting means comprising a motion transmitting member at least partly confined by said movable actuator means as to be extending therefrom and towards said oscillatingly movable motion transmitting means, said manually movable actuator means comprising plunger-like means axially movable in directions generally toward and away from said oscillatingly movable motion transmitting means, first spring means carried by said switch body means, said first spring means operatively engaging and urging said plunger-like means in one of said directions generally away from said oscillatingly movable motion transmitting means, recess-like chamber means formed in one axial end of said movable actuator means, said motion transmitting member comprising a main body portion received within said recess-like chamber means as to be relatively movable thereto, and second spring means carried by said actuator means and operatively engaging said motion transmitting member, said second spring means being effective to normally urge said motion transmitting member to a position as to be extending generally aligned with the axis of movement of said movable actuator means and between opposite extreme operating positions of said motion transmitting member, said recess-like chamber means comprising abutment surface means carried by said movable actuator means, said second spring means being effective for urging said motion transmitting member into abutting engagement with said abutment surface means, said main body portion comprising first and second abutment portions effective for engaging said abutment surface means, said first and second abutment portions being spaced from each other, and each of said first and second abutment portions serving generally as fulcrum means as said motion transmitting member is moved to and from said two extreme operating positions.

8. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first plurality of operating positions to an other of said first plurality of operating positions, and resilient detent means, said resilient detent means being effective to resiliently resist the movement of said oscillatingly movable motion transmitting means from said one of said second plurality of operating positions toward said other of said second plurality of operating positions and from said other of said second plurality of operating positions toward said one of said second plurality of operating positions, said resilient detent means comprising spring means carried by said switch body means generally internally thereof, said spring means comprising an engaging portion operatively engaging said oscillatingly movable motion transmitting means, said oscillatingly movable motion transmitting means comprising a generally radially projecting portion defining at opposite sides thereof first and second detent recess portions, said engaging portion being seated in said first detent recess portion when said oscillatingly movable motion transmitting means is in said one of said second plurality of operating positions, and said engaging portion being seated in said second detent recess portion when said oscillatingly movable motion transmitting means is in said other of said second plurality of operating positions.

9. An electrical switch assembly, comprising switch body means, chamber means formed generally internally of said switch body means, a plurality of stationary electrical contacts disposed within said chamber means, linearly movable contact means slidably movable to a first plurality of operating positions and engageable with said plurality of stationary electrical contacts, oscillatingly movable motion transmitting means carried within said chamber means and movable to a second plurality of operating positions, said oscillatingly movable motion transmitting means being operatively connected to said movable contact means, manually movable actuator means carried by said switch body means and movable relative thereto, resiliently deflectable motion transmitting means operatively carried by said manually movable actuator means and effective for operatively engaging said oscillatingly movable motion transmitting means, said resiliently deflectable motion transmitting means being effective upon actuation of said movable actuator means to move said oscillatingly movable motion transmitting means from one of said second plurality of operating positions to an other of said second plurality of operating positions and to thereby move said movable contact means from one of said first plurality of operating positions to an other of said first plurality of operating positions, said resiliently deflectable motion transmitting means comprising a motion transmitting member at least partly confined by said movable actuator means as to be extending therefrom and towards said oscillatingly movable motion transmitting means, said manually movable actuator means comprising plunger-like means axially movable in directions generally toward and away from said oscillatingly movable motion transmitting means, spring means carried by said switch body means, said spring means operatively engaging said urging said plunger-like means in one of said directions generally away from said oscillatingly movable motion transmitting means, recess-like means formed in one axial end of said movable actuator means, said motion transmitting member comprising a main body portion received within said recess-like means as to be relatively movable thereto, and second spring means carried by said actuator means and operatively engaging said motion transmitting member, said second spring means being effective to normally urge said motion transmitting member to a generally medial position between two extreme operating positions of said motion transmitting member.

10. An electrical switch assembly according to claim 9 wherein said recess-like means comprises an abutment surface carried by said movable actuator means, and wherein said second spring means is effective for urging said motion transmitting member into abutting engagement with said abutment surface.

11. An electrical switch assembly according to claim 10 wherein said main body portion comprises first and second abutment portions effective for engaging said abutment surface, wherein said first and second abutment portions are spaced from each other, and wherein each of said first and second abutment portions serves generally as fulcrum means as said motion transmitting member is moved to and from said two extreme operating positions.

12. An electrical switch assembly according to claim 11 wherein said switch body meaans comprises a plurality of separable switch body sections, and further comprising outer housing means situated generally about said plurality of separable switch body sections and containing said plurality of separable switch body sections in assembled relationship.

13. An electrical switch assembly according to claim 9 wherein said oscillatingly movable motion transmitting means comprises a pivotally mounted body member, said body member comprising first and second pivot members carried thereby and coaxially extending therefrom in directions opposite to each other, and further comprising first and second journal portions carried by said switch body means effective for respectively supporting said first and second pivot members, wherein said pivotally mounted body member comprises first and second abutment portions disposed eccentrically with respect to the coaxial pivotal axes of said first and second pivot members, and wherein said first abutment portion is operatively engaged by said resiliently deflectable motion transmitting when said resiliently deflectable motion transmitting means is effective in moving said oscillatingly movable motion transmitting means from said one of said second plurality of operating positions toward said other of said second plurality of operating positions.

14. An electrical switch assembly according to claim 9 wherein said movable contact means comprises an electrically conductive contact member, a slider body operatively connected to said electrically conductive contact member, and further comprising guide means carried by said switch body means generally within said chamber means, said guide means operatively connecting said slider body as to provide for guided sliding motion of said slider body.

15. An electrical switch assembly according to claim 9 wherein said movable contact means comprises an electrically conductive contact member, a slider body operatively connected to said electrically conductive contact member, and spring means situated generally between said slider body and said electrically conductive contact member, said spring means being effective to resiliently urge said electrically conductive contact member generally away from said slider body and towards said stationary electrical contacts.

16. An electrical switch assembly according to claim 9 wherein movable contact means comprises an electrically conductive contact member, a slider body operatively connected to said electrically conductive contact member, and further comprising guide means carried by said switch body means generally within said chamber means, said guide means operatively engaging said slider body as to provide for guided sliding motion of said slider body, and spring means situated generally between said slider body and said electrically conductive contact member, said spring means being effective to resiliently urge said electrically conductive contact member generally away from said slider body and towards said stationary electrical contacts.

17. An electrical switch assembly according to claim 16 wherein said switch body means comprises a plurality of separable switch body sections, and further comprising outer housing means situated generally about said plurality of separable switch body sections and containing said plurality of separable switch body sections in assembled relationship.

18. An electrical switch assembly according to claim 9 and further comprising resilient detent means, said resilient detent means being effective to resiliently resist the movement of said oscillatingly movable motion transmitting means from said one of said second plurality of operating positions toward said other of said second plurality of operating positions and from said other of said second plurality of operating positions toward said one of said second plurality of operating positions.

19. An electrical switch assembly according to claim 18 wherein said resilient detent means is effective to resiliently resist the movement of said oscillatingly movable motion transmitting means for only a first portion of said movement from said one of said second plurality of operating positions toward said other of said second plurality of operating positions and is effective to resiliently aid in the said movement of said oscillatingly movable motion transmitting means during a second portion of said movement from said one of said second plurality of operating positions toward said other of said second plurality of operating positions.

20. An electrical switch assembly according to claim 9 wherein said switch body means comprises a plurality of separable switch body sections, wherein said plurality of separable switch body sections comprise first and second body sections, said first body section having a first inner generally planar surface and a second outer generally semi-cylindrical surface, said second body section having a third inner generally planar surface and a fourth outer generally semi-cylindrical surface, wherein saaid first and second body sections are assembled to each other as to cause said first and third surfaces to be juxtaposed to each other and said second and fourth surfaces to be disposed outwardly thereof and cooperating to define a cylindrical outer configuration.

21. An electrical switch assembly according to claim 20 wherein said plurality of separable switch body sections further comprise third and fourth body sections, wherein said third body section comprises a generally cylindrical end body section adapted for assembly to a first axial end of said assembled first and second body sections, and wherein said fourth body section comprises a disc-like body section adapted for assembly to a second axial end of said assembled first and second body sections opposite to said first axial end.

22. An electrical switch assembly according to claim 21 wherein said plurality of stationary electrical contacts are carried by said fourth body section.

23. An electrical switch assembly according to claim 21 wherein said first and second body sections cooperate to define a generally cylindrical passage therebetween, wherein said manually movable actuator means comprises a generally cylindrical plunger-like structure slidably receivable in said cylindrical passage, and wherein said plunger-like structure is also slidably received through clearance passage means formed in said third body section.

24. An electrical switch assembly according to claim 20 wherein said movable contact means comprises a slidable slider body, a movable electrical contact carried by said slider body, and further comprising guide means for slidably guiding said slider body, said guide means comprising first groove-like recess means formed in said first body section and second groove-like recess means formed in said second body section, said first and second groove-like recess means effectively containing and guiding said slider body during movement thereof.

25. An electrical switch assembly according to claim 9 wherein said movable contact means comprising a contact main body, said contact main body carrying generally linearly extending contacting surfaces effective for sliding contacting engagement with said plurality of stationary electrical contacts, and said contacting surfaces being spaced from each other and projecting generally away from said main body and extending in directions generally parallel to the sliding movability of said movable contact means.

26. An electrical switch assembly according to claim 25 wherein saaid contacting surfaces comprise at least first second and third contacting surfaces each generally parallel to the other.

27. An electrical switch assembly according to claim 26 wherein the spacing between said first and second contacting surfaces is considerably greater than the spacing between said second and third contacting surfaces.

28. An electrical switch assembly according to claim 25 wherein said contacting surfaces comprise at least first second and third and fourth contacting surfaces each generally parallel to each other.

29. An electrical switch assembly according to claim 28 wherein the spacing between said first and second contacting surfaces is substantially less than the spacing between said second and third contacting surfaces, and wherein the spacing between said second and third contacting surfaces is substantially greater than the spacing between said third and fourth contacting surfaces.

30. An electrical switch assembly according to claim 25 and further comprising groove means formed in said contacting surfaces generally transversely thereof thereby defining a plurality of generally transverse edges spaced from each other along said contacting surfaces.

31. An electrical switch assembly according to claim 28 and further comprising groove means formed in said contacting surfaces generally transversely thereof thereby defining a plurality of generally transverse edges spaced from each other along said contacting surfaces.

32. An electrical switch assembly according to claim 29 and further comprising groove meaans formed in said contacting surfaces generally transversely thereof thereby defining a plurality of generally transverse edges spaced from each other along said contacting surfaces.

* * * * *

UNITED STATES PATENT AND TRADEMARK OFFICE

CERTIFICATE OF CORRECTION

PATENT NO. : 4,204,102

DATED : May 20, 1980

INVENTOR(S) : David W Bull

It is certified that error appears in the above-identified patent and that said Letters Patent are hereby corrected as shown below:

Column 7, line 63, change "247" to --- 274 ---.

Claim 26, line 2 thereof, change "saaid" to --- said ---.

Claim 32, line 2 thereof, change "meaans" to --- means ---.

Signed and Sealed this

*Sixth* Day of *January 1981*

[SEAL]

*Attest:*

SIDNEY A. DIAMOND

*Attesting Officer*

*Commissioner of Patents and Trademarks*